US010316504B2

(12) United States Patent
Jones et al.

(10) Patent No.: US 10,316,504 B2
(45) Date of Patent: Jun. 11, 2019

(54) VACUUM SEWAGE SYSTEM WITH MONITORING SYSTEM AND METHOD OF USE

(71) Applicant: Aqseptence Group, Inc., New Brighton, MN (US)

(72) Inventors: Mark Jones, Rochester, IN (US); Clint Hawn, Winona Lake, IN (US)

(73) Assignee: Aqseptence Group, Inc., New Brighton, MN (US)

( * ) Notice: Subject to any disclaimer, the term of this patent is extended or adjusted under 35 U.S.C. 154(b) by 0 days.

(21) Appl. No.: 15/176,233

(22) Filed: Jun. 8, 2016

(65) Prior Publication Data

US 2017/0037611 A1 Feb. 9, 2017

Related U.S. Application Data

(60) Provisional application No. 62/201,234, filed on Aug. 5, 2015.

(51) Int. Cl.
*E03F 1/00* (2006.01)
*F04C 25/02* (2006.01)
(Continued)

(52) U.S. Cl.
CPC ..... *E03F 1/006* (2013.01); *E03F 1/007* (2013.01); *F04C 13/001* (2013.01); *F04C 25/02* (2013.01); *F04C 28/02* (2013.01)

(58) Field of Classification Search
CPC ..... E03F 1/006; E03F 1/007; Y10T 137/402; Y10T 137/3109; F04C 13/001; F04C 28/02; F04C 25/02
(Continued)

(56) References Cited

U.S. PATENT DOCUMENTS 4,155,851 A 5/1979 Michael
4,179,371 A 12/1979 Foreman et al.
(Continued)

FOREIGN PATENT DOCUMENTS

DE 2637962 A1 3/1978
DE 3520538 A1 12/1986
(Continued)

OTHER PUBLICATIONS

European Patent Office, International Search Report in a corresponding patent application, dated Nov. 14, 2016, 8 pages.
(Continued)

*Primary Examiner* — Ian G Paquette
(74) *Attorney, Agent, or Firm* — Barnes & Thornburg LLP

(57) ABSTRACT

A vacuum sewage system includes a collection station, a vacuum pump, a sewage pump, a collection tank, a control system, a valve pit, a first conduit extending from the collection station to the valve pit, a second conduit extending from the valve pit and terminating in a closed end, a valve located in the valve pit for selectively permitting sewage and waste water to flow from the valve pit toward the collection station upon activation of the valve, an electric air admission controller or a solenoid for selectively opening and closing the valve, a first sensor associated with the electronic air admission controller or the solenoid and a second sensor located adjacent the closed end of the second conduit. The system may be utilized to monitor and remedy various undesirable operating conditions in the system and to perform routines to increase operating efficiency of the system.

16 Claims, 4 Drawing Sheets

(51) Int. Cl.
*F04C 28/02* (2006.01)
*F04C 13/00* (2006.01)

(58) Field of Classification Search
USPC ..... 406/22, 93
See application file for complete search history.

(56) References Cited

U.S. PATENT DOCUMENTS

| | | | | |
|---|---|---|---|---|
| 5,044,836 | A | 9/1991 | Grooms | |
| 5,083,885 | A * | 1/1992 | Ushitora | E03F 1/006 137/236.1 |
| 5,487,646 | A | 1/1996 | Ushitora et al. | |
| 6,206,646 | B1 | 3/2001 | Bucher | |
| 9,541,088 | B2 * | 1/2017 | Kawamura | C23C 16/4412 |
| 2011/0180161 | A1 | 7/2011 | Boren | |
| 2011/0192465 | A1 * | 8/2011 | Collings, III | E03F 1/006 137/1 |
| 2015/0346734 | A1 * | 12/2015 | Blocher | G05D 7/0641 137/565.23 |

FOREIGN PATENT DOCUMENTS

| | | | |
|---|---|---|---|
| DE | 10159835 | A1 | 6/2003 |
| EP | 0415360 | A2 | 3/1991 |
| EP | 0943805 | A1 | 9/1999 |
| GB | 2017188 | A | 10/1979 |

OTHER PUBLICATIONS

European Patent Office, Written Opinion in a corresponding patent application, dated Nov. 22, 2016, 14 pages.
European Patent Office, Partial International Search Report issued in a corresponding international patent application, dated Aug. 18, 2016, 3 pages.

* cited by examiner

VACUUM SEWAGE SYSTEM WITH MONITORING SYSTEM AND METHOD OF USE

The present invention relates generally to sewage systems which utilize differential pressures to produce sewage transport through the system and, in particular, to such a sewage system having a monitoring system for determining the conditions prevailing at various locations in the system. The present invention also relates to methods for using such a system.

SUMMARY OF THE INVENTION

In one embodiment of the present invention, a vacuum sewage system includes a collection station, a vacuum pump located at the collection station, a sewage pump located at the collection station, a collection tank located at the collection station, a control system located at the collection station, a valve pit, a first conduit extending from the collection station to the valve pit, a second conduit extending from the valve pit and terminating in a closed end, a valve located in the valve pit for selectively permitting sewage and waste water to flow from the valve pit toward the collection station upon activation of the valve, an electric air admission controller for selectively opening and closing the valve, a first sensor associated with the electric air admission controller and a second sensor located adjacent the closed end of the second conduit.

In one embodiment, the electric air admission controller is replaced by a solenoid In another embodiment, the control system includes a programmable controller. The control system may also include means for communicating with the first and second sensors. The means for communicating with the first and second sensors can include wireless communication means.

In another embodiment of the present invention, the first conduit has a section with a repeating series of risers, low points and down slopes. The down slopes may be inclined at an angle of 0.1% relative to a horizontal plane.

In one embodiment of the present invention, a method of operating a vacuum sewage system includes the steps of utilizing a sensor to detect system vacuum level at a location in the system, comparing the detected system vacuum level to a previously specified system vacuum level, detecting the operating time of a sewage pump and comparing the detected operating time of the sewage pump with a previously specified operating time range. If the detected system vacuum level is at or below the previously specified system vacuum level and the detected operating time of the sewage pump is within the previously specified operating time range, a valve is selectively opened and closed in a previously specified timing cycle so as to admit air into the sewage system. The method of this embodiment further includes the steps of detecting the vacuum level at a sewage collection station and comparing the detected vacuum level at the sewage collection station with a first previously specified collection station vacuum level. If the detected vacuum level at the sewage collection station is below the first previously specified collection station vacuum level, a first vacuum pump is operated while continuing to detect the vacuum level at the sewage collection station and comparing the detected vacuum level at the sewage collection station to a second previously specified collection station vacuum level. If the detected vacuum level at the sewage collection station is below the second previously specified collection station vacuum level during operation of the first vacuum pump, a second vacuum pump is operated. The valve is selectively opened and closed so as to admit air into the sewage system in the previously specified timing cycle until the detected system vacuum level reaches or exceeds the previously specified system vacuum level.

In one embodiment, the previously specified system vacuum level is approximately 12 inches of mercury.

In another embodiment, the previously specified sewage pump operating time range is less than approximately 3.5 minutes.

In another embodiment, the first previously specified collection station vacuum level is approximately 16 inches of mercury. The second previously specified collection station vacuum level may be approximately 15 inches of mercury in some embodiments.

In another embodiment of the invention, the previously specified timing cycle for the valve is 20 seconds open and 10 minutes closed.

In one embodiment, the system vacuum level is detected at the end of a conduit.

In another embodiment, an electric air admission controller is used to operate the valve. Alternatively, a solenoid may be used to operate the valve.

In one embodiment of the present invention, a method of operating a vacuum sewage system includes the steps of determining an anticipated peak operating time of the sewage system, specifying a purge start time prior to the anticipated peak operating time, at the specified purge start time, selectively opening and closing a valve in the sewage system in a previously specified timing cycle so as to admit air into the sewage system, detecting the vacuum level at a sewage collection station and comparing the detected vacuum level at the sewage collection station with a first previously specified collection station vacuum level. If the detected vacuum level at the sewage collection station is below the first previously specified collection station vacuum level, a first vacuum pump is operated while continuing to detect the vacuum level at the sewage collection station and comparing the detected vacuum level at the sewage collection station to a second previously specified collection station vacuum level. If the detected vacuum level at the sewage collection station is below the second previously specified collection station vacuum level during operation of the first vacuum pump, a second vacuum pump is operated. The valve is selectively opened and closed for a previously specified time period so as to admit air into the sewage system in the previously specified timing cycle.

In one embodiment of the invention, the first previously specified collection station vacuum level is approximately 16 inches of mercury. In another embodiment of the invention, the second previously specified collection station vacuum level is approximately 15 inches of mercury.

In one embodiment, the previously specified timing cycle for the valve is 20 seconds open and 10 minutes closed. In another embodiment, an electric air admission controller is used to operate the valve. In one embodiment, a solenoid is used to operate the valve.

In one embodiment of the invention, the previously specified time period is approximately 30 minutes.

In one embodiment of the present invention, a method of operating a vacuum sewage system includes the steps of specifying a sewage pump cavitation point, utilizing a sensor to detect system vacuum level at a location in the system, comparing the detected system vacuum level to a previously specified system vacuum level, detecting the operating time of a sewage pump and comparing the detected operating time of the sewage pump with a previously specified operating time. If the detected system vacuum level is below the previously specified system vacuum level and the detected operating time of the sewage pump is longer than the previously specified operating time, a first vacuum pump is operated while monitoring the vacuum level at a sewage collection station The monitored vacuum level at the sewage collection station is compared with a first previously specified collection station vacuum level, the operation of the sewage pump is monitored and the first vacuum pump is continued in operation until either the monitored vacuum level at the sewage collection station reaches or exceeds the first previously specified collection station vacuum level or until the sewage pump reaches a point just below its cavitation point, whichever occurs first. The method further includes the steps of continuing to monitor the operating time of the sewage pump during operation of the first vacuum pump and comparing the operating time of the sewage pump to a previously specified operating time range. When the monitored operating time of the sewage pump is within the previously specified operating time range, the method includes performing the following additional steps: selectively opening and closing a valve in the sewage system in a previously specified timing cycle so as to admit air into the sewage system, detecting the vacuum level at the sewage collection station, comparing the detected vacuum level at the sewage collection station with a second previously specified collection station vacuum level, if the detected vacuum level at the sewage collection station is below the second previously specified collection station vacuum level, operating the first vacuum pump, continuing to detect the vacuum level at the sewage collection station during operation of the first vacuum pump and comparing the detected vacuum level at the sewage collection station to a third previously specified collection station vacuum level, if the detected vacuum level at the sewage collection station is below the third previously specified collection station vacuum level during operation of the first vacuum pump, operating the second vacuum pump and continuing to selectively open and close the valve so as to admit air into the sewage system until the detected system vacuum level reaches or exceeds the previously specified system vacuum level.

In one embodiment of the invention, the previously specified system vacuum level is approximately 12 inches of mercury.

In another embodiment of the invention, the previously specified sewage pump operating time is approximately 4.5 minutes. In one embodiment, the previously specified sewage pump operating time range is less than approximately 3.5 minutes.

In another embodiment of the invention, the first previously specified collection station vacuum level is approximately 22 inches of mercury. In another embodiment, the second previously specified collection station vacuum level is approximately 16 inches of mercury. In one embodiment, the third previously specified collection station vacuum level is approximately 15 inches of mercury.

In another embodiment of the invention, the previously specified timing cycle for the valve is 20 seconds open and 10 minutes closed.

In one embodiment, the system vacuum level is detected at the end of a conduit.

In another embodiment, an electric air admission controller is used to operate the valve. In one embodiment, a solenoid is used to operate the valve.

DETAILED DESCRIPTION OF THE EMBODIMENTS OF THE INVENTION

Figure 1:
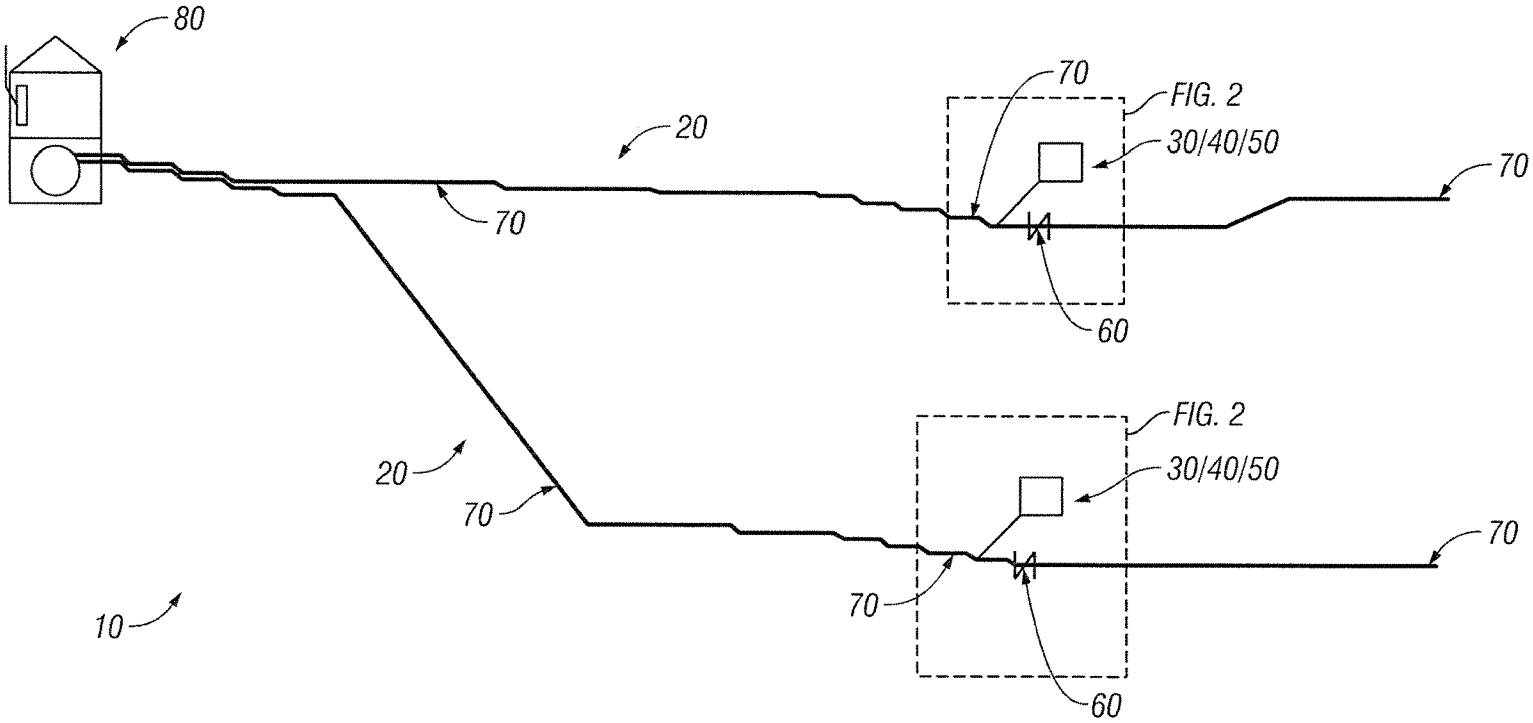
FIG. 1 is a schematic view of a vacuum sewage system according to one embodiment of the present invention.
Figure 2:
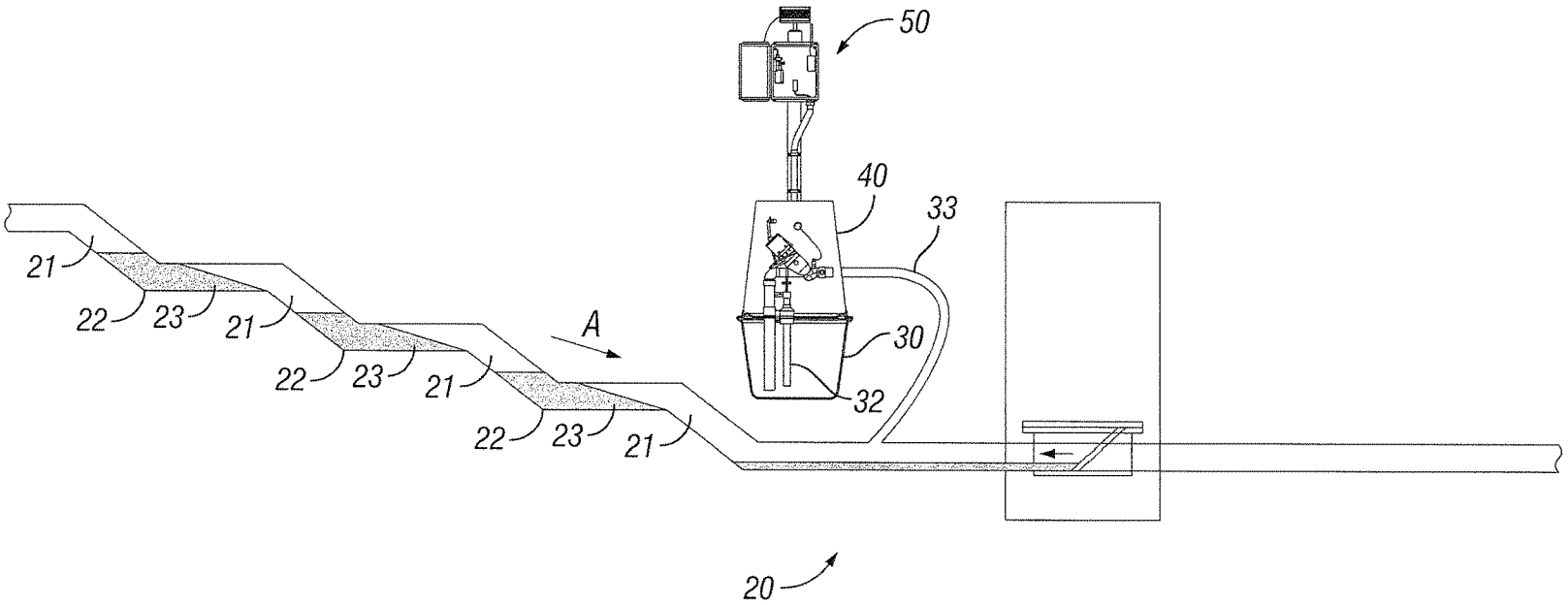
FIG. 2 is a detail view of the areas indicated in FIG. 1 by reference "FIG. 2."

FIGS. 1 and 2 illustrate a vacuum sewage system 10 according to one embodiment of the present invention. System 10 generally includes a series of conduits 20, holding tanks 30, valve pits 40, electric air admission controllers ("EAAC") 50, check valves 60, sensors 70 and a collection station 80.

Conduits 20 are typically laid out in a saw-toothed pattern with a repeating series of risers 21, low points 22, and downslopes 23 (each series collectively called a "lift"). In certain prior art devices, the downslopes are inclined at an angle of 0.2%. In one embodiment of the present invention, downslopes 23 are inclined in the direction of arrow "A" at an angle of 0.1%. Laser leveling and surveying technology may be used to accurately position downslopes 23. Reducing the angle of incline of downslopes 23 can reduce the number of lifts required in system 10 (in some applications reducing the number of lifts by 50%) which permits larger networks of conduit 20. The 0.1% downslope angle also reduces vacuum loss throughout system 10.

Figure 3:
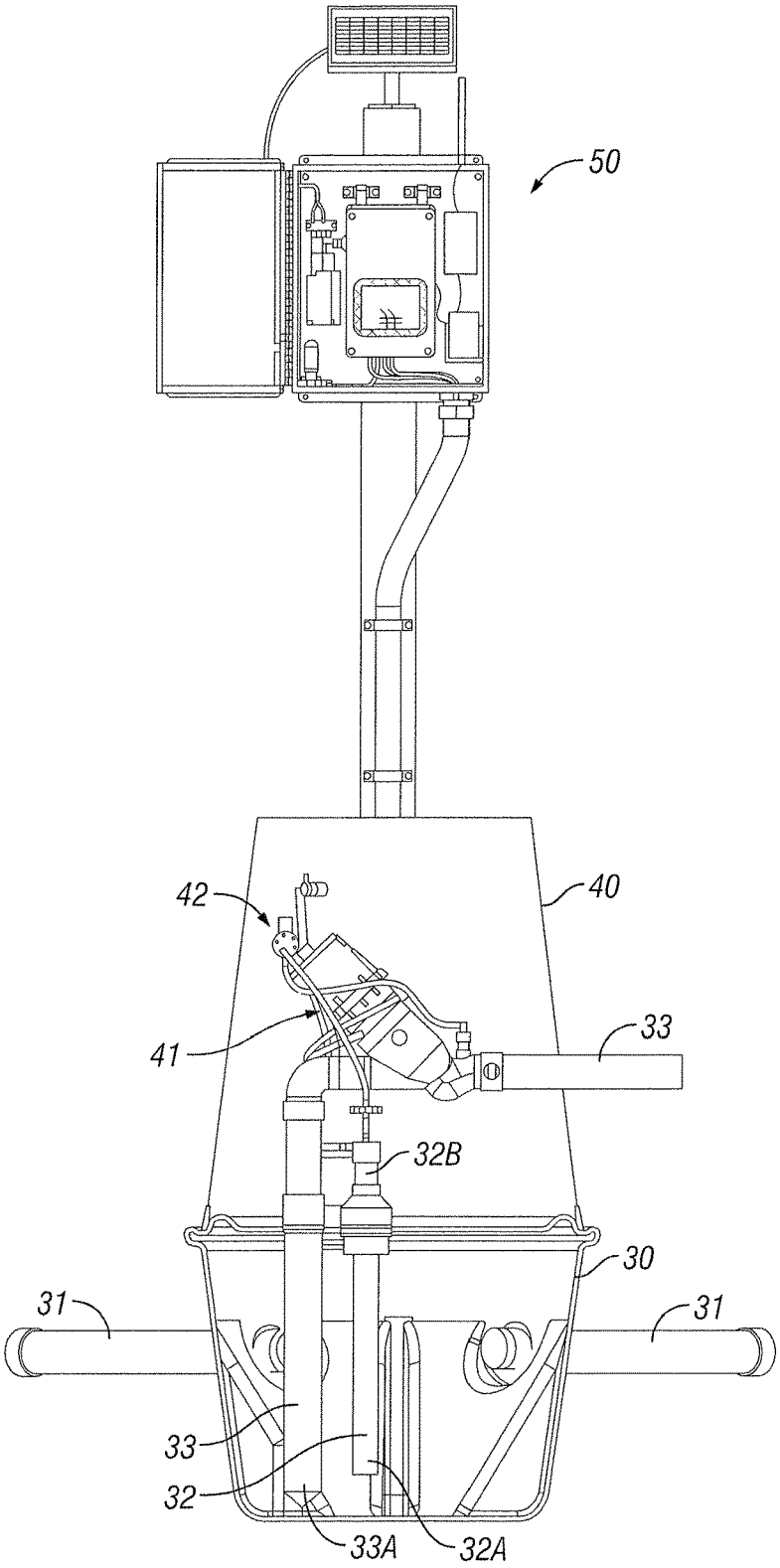
FIG. 3 is a partial sectional view of a valve pit and electric air admission controller that are components of the system of FIG. 1.
Figure 4:
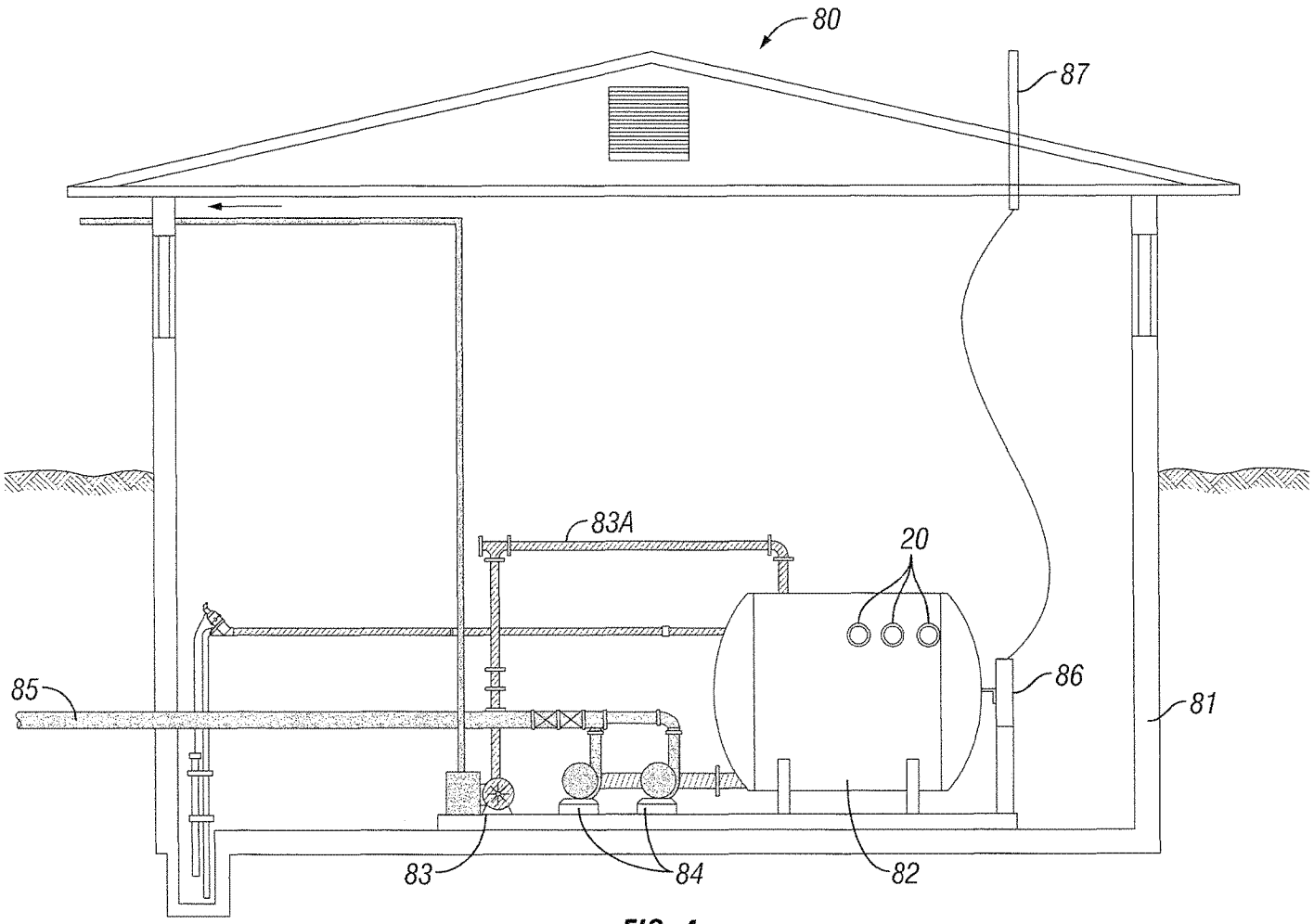
FIG. 4 is an elevational view of a collection station that is a component of the system of FIG. 1.

Referring to FIGS. 2 and 3, conduits 31 transport sewage to holding tank 30, which is maintained at atmospheric pressure. A sensor pipe 32 and a discharge conduit 33 extend into tank 30. A first end 32A of pipe 32 extends downwardly into tank 30 to a point spaced above the inlet opening 33A of a discharge conduit 33. The second end 32B of pipe 32 extends into a valve pit 40. Discharge conduit 33 extends into the valve pit 40 to a valve 41. Numerous types of valves 41 are known in the industry. One example of a valve 41 that can be used with system 10 is disclosed in U.S. Pat. No. 4,171,853. Valve 41 is operated by a controller 42. The section of discharge conduit 33 downstream from valve 41 is maintained at vacuum or low pressure by vacuum pumps (described below). Discharge conduit 33 ultimately discharges into collection station 80, which is also maintained at vacuum or low pressure.

In use, sewage is discharged through conduit 31 into tank 30. Under preselected pressure conditions in tank 30 (i.e. when the sewage content of tank 30 is such that a discharge cycle is warranted) valve 41 is opened by controller 42. Opening valve 41 creates a differential pressure between the relatively low pressure or vacuum portion of discharge conduit 33 downstream from valve 41 and the relatively higher or atmospheric pressure portion of discharge conduit 33 upstream from valve 41. This pressure differential causes discharge of the sewage in tank 30 through inlet opening 33A of discharge conduit 33, past valve 41, through the portion of discharge conduit 33 downstream from valve 41 and ultimately to collection station 80.

Collection station 80 generally includes a shed or other enclosure 81, a collection tank 82, one or more vacuum pumps 83, sewage pumps 84, sewage discharge conduit 85 and a control system 86 which, in the embodiment shown, includes a programmable controller including wireless communication means, and a wireless communication antenna 87. Conduits 20 discharge into collection tank 82. Vacuum pump 83 is associated piping 83A and draws a vacuum on collection tank 82 and through conduits 20 of system 10. Sewage pumps 84 discharge sewage from collection tank 82 through discharge pipe 85 to a sewage treatment facility (not shown.) Control system 86 and antenna 87 communicate with sensors 70 as described below.

Upon completion of a transport cycle, valve 41 is automatically closed and the vacuum sewage transport system of the invention is restored to the stand-by condition. With the saw-toothed arrangement of conduits 20 discussed above, sewage that was not transported to collection station 80 will generally come to rest in the low points 22 and will not seal the conduit 20 when the transport cycle ends. This permits the same vacuum pressure to be distributed throughout the conduits 20, including that portion of the conduit above the material in the low portion 22 of the conduit. However, vacuum sewage systems can sometimes experience a condition known as "waterlogging." Waterlogging occurs when residual waste matter in conduit 20 accumulates to the point that fills all or a significant portion of the conduit cross section (such as two-thirds or more) as shown in FIG. 2. This prevents the vacuum pressure produced by vacuum pump 83 from being communicated through the entire network of conduits 20.

EAAC's 50 may be used to monitor the vacuum level at the location of the EAAC. One suitable EAAC is described in U.S. Pat. No. 5,044,836. If the localized vacuum level drops, due to factors such as waterlogging, the EAAC can activate a valve 41 and admit additional air into system 10, thereby clearing the waterlogged condition. With the present invention, sensors 70 located at the ends of conduits 20 and elsewhere in system 10 can be used to monitor vacuum levels throughout the system, not just at EAAC's 50. In one embodiment of the invention, sensors 70 are pressure transducers that measure the vacuum level and convert it to a voltage scaled to the vacuum level. Other types of sensors may be used in addition to or instead of pressure transducers. Sensors 70 include wireless communication technology for transmitting vacuum-level readings to control system 86. In this manner, collection station 80 can monitor the conditions in system 10 and clear residual sewage and maintain vacuum pressure. For example, when an insufficient vacuum is detected at one or more of sensors 70, control system 86 can activate vacuum pump 83 to increase vacuum in the system and clear residual sewage. In addition, or alternatively, control system 86 can send a signal to one or more of EAAC's 50 to activate its associated valve 41 to introduce additional air into the system, thereby clearing residual sewage. Use of sensors 70 and EAAC's 50 in this manner is particularly useful in clearing residual waste matter that may be more likely to accumulate in systems 20 that utilize downslopes 23 angled at 0.1% as discussed above. Locating check valves 60 behind the various lifts in conduits 20 prevents backflow through system 10. The use of check valves 60 positioned in this manner may be particularly beneficial when used in connection with the 0.1% angle downslopes 23 of conduits 20.

The system of the present invention may be programmed to detect certain parameters which indicate a potential waterlogging situation. For example, if the vacuum detected by a sensor 70 at the end of a conduit 20 is less than 12 inches of mercury but the operating time of sewage pump 84 is normal, for example, less than three and one-half minutes, the system 10 may be experiencing a waterlogged condition. In one method of eliminating a waterlogged condition according to an embodiment of the present invention, one or more EAAC's 50 are cycled on and off to admit air into system 10. For example, EAAC's 50 may be utilized to open valves 41 for 20 seconds followed by a 10 minute closed period. In conjunction with operating EAAC's 50, one of the vacuum pumps 83 is activated when the vacuum at station 80 drops below a pre-set level. For example, normal vacuum at station 83 may be between 16 inches of mercury and 20 inches of mercury and a vacuum pump 83 may be operated when that pressure drops to 16 inches of mercury or below. Additional vacuum pumps 83 may be activated in a timed sequence subsequent to activation of the first vacuum pump 83 if the vacuum level at station 80 drops below 15 inches of mercury. The activation cycle of EAAC's 50 and vacuum pumps 83 may be continued until the vacuum at the end of conduit 20 rises above 12 inches of mercury.

System 10 of the present invention may also be utilized to run a purge cycle to clear system 10 prior to anticipated peak operating times. A purge start time can be selected such as, for example, two hours before an anticipated peak operating time. These anticipated peak operating times may, for example, be a time when it is anticipated users will be waking in the morning to prepare for school, work or other activities or returning home for the day. To purge system 10, one or more EAAC's 50 may be cycled on and off. For example, EAAC's 50 may be utilized to open valves 41 for 20 seconds followed by a 10 minute closed period. In conjunction with operating EAAC's 50, one of the vacuum pumps 83 is activated when the vacuum at station 80 drops below a pre-set level. For example, a vacuum pump 83 may be operated when the pressure at station 80 drops to 16 inches of mercury or below. Additional vacuum pumps 83 may be activated in a timed sequence subsequent to activation of the first vacuum pump 83 if the vacuum level at station 80 drops below 15 inches of mercury. The activation cycle of EAAC's 50 and vacuum pumps 83 may be continued for a pre-set time period, for example, for 30 minutes.

System 10 of the present invention can also be used to reduce or eliminate the effects of friction losses associated with heavy usage. Under heavy use situations, sewage pump 84 may operate for longer than desired time intervals as a result of the increased work required to move large amounts of sewage through conduits 20. This increased work is attributable at least in part to increased friction between the large amounts of sewage moving through the system and the interior surfaces of conduits 20. For example, the system 10 may be programmed to remediate a friction loss situation when the vacuum detected at the end of a conduit 20 drops below 12 inches of mercury and the operation time of sewage pump 84 is greater than four and one-half minutes. This situation may be addressed by a two stage process. In the first stage, one or more of the vacuum pumps 83 are operated until the vacuum level at the station increases to 22 inches of mercury or until a point just below the cavitation point of sewage pump 84, whichever occurs first. When the operating time of sewage pump 84 drops back to its normal range such as, for example, less than three and one-half minutes, a second remediation stage is begun in which the purge cycle described above is carried out until the vacuum at the end of conduit 20 rises above 14 inches of mercury.

Although the present invention has been shown and described in detail the same is to be taken by way of example only and not by way of limitation. Numerous changes can be made to the embodiments described without departing from the scope of the invention. For example, EAAC's 50 could be replaced with solenoids that activate valves 41. Furthermore, the methods described above for addressing a waterlogged condition, purging the system and/or reducing friction loss in high flow situations may be performed using different pressure and timing parameters than those specifically described above.

What is claimed is:

1. A method of operating a vacuum sewage system including the steps of:

utilizing a sensor to detect system vacuum level at a location in the system;

comparing the detected system vacuum level to a previously specified system vacuum level;

detecting the operating time of a sewage pump;

comparing the detected operating time of the sewage pump with a previously specified operating time range;

if the detected system vacuum level is at or below the previously specified system vacuum level and the detected operating time of the sewage pump is within the previously specified operating time range, selectively opening and closing a valve in the sewage system in a previously specified timing cycle so as to admit air into the sewage system;

detecting the vacuum level at a sewage collection station;

comparing the detected vacuum level at the sewage collection station with a first previously specified collection station vacuum level;

if the detected vacuum level at the sewage collection station is below the first previously specified collection station vacuum level, operating a first vacuum pump;

continuing to detect the vacuum level at the sewage collection station during operation of the first vacuum pump and comparing the detected vacuum level at the sewage collection station to a second previously specified collection station vacuum level;

if the detected vacuum level at the sewage collection station is below the second previously specified collection station vacuum level during operation of the first vacuum pump, operating a second vacuum pump; and continuing to selectively open and close the valve so as to admit air into the sewage system in the previously specified timing cycle until the detected system vacuum level reaches or exceeds the previously specified system vacuum level.

2. The method according to claim 1, wherein the previously specified system vacuum level is approximately 12 inches of mercury.

3. The method according to claim 1, wherein the previously specified sewage pump operating time range is less than approximately 3.5 minutes.

4. The method according to claim 1, wherein the first previously specified collection station vacuum level is approximately 16 inches of mercury.

5. The method according to claim 1, wherein the second previously specified collection station vacuum level is approximately 15 inches of mercury.

6. The method according to claim 1, wherein the previously specified timing cycle for the valve is 20 seconds open and 10 minutes closed.

7. The method according to claim 1, wherein the system vacuum level is detected at the end of a conduit.

8. The method of claim 1, wherein an electric air admission controller is used to operate the valve.

9. The method according to claim 1, wherein a solenoid is used to operate the valve.

10. A method of operating a vacuum sewage system including the steps of:

determining an anticipated peak operating time of the sewage system;

specifying a purge start time prior to the anticipated peak operating time;

at the specified purge start time, selectively opening and closing a valve in the sewage system in a previously specified timing cycle so as to admit air into the sewage system;

detecting the vacuum level at a sewage collection station;

comparing the detected vacuum level at the sewage collection station with a first previously specified collection station vacuum level;

if the detected vacuum level at the sewage collection station is below the first previously specified collection station vacuum level, operating a first vacuum pump;

continuing to detect the vacuum level at the sewage collection station during operation of the first vacuum pump and comparing the detected vacuum level at the sewage collection station to a second previously specified collection station vacuum level;

if the detected vacuum level at the sewage collection station is below the second previously specified collection station vacuum level during operation of the first vacuum pump, operating a second vacuum pump; and continuing for a previously specified time period to selectively open and close the valve so as to admit air into the sewage system in the previously specified timing cycle.

11. The method according to claim 10, wherein the first previously specified collection station vacuum level is approximately 16 inches of mercury.

12. The method according to claim 10, wherein the second previously specified collection station vacuum level is approximately 15 inches of mercury.

13. The method according to claim 10, wherein the previously specified timing cycle for the valve is 20 seconds open and 10 minutes closed.

14. The method according to claim 10, wherein an electric air admission controller is used to operate the valve.

15. The method according to claim 10, wherein a solenoid is used to operate the valve.

16. The method according to claim 10, wherein the previously specified time period is approximately 30 minutes.

* * * * *